US011854711B2

(12) United States Patent
Sandquist

(10) Patent No.: US 11,854,711 B2
(45) Date of Patent: Dec. 26, 2023

(54) PRODUCTIONS OF RADIOISOTOPES

(71) Applicant: Gary M Sandquist, Salt Lake City, UT (US)

(72) Inventor: Gary M Sandquist, Salt Lake City, UT (US)

(73) Assignee: Gary M. Sandquist, Salt Lake City, UT (US)

( * ) Notice: Subject to any disclaimer, the term of this patent is extended or adjusted under 35 U.S.C. 154(b) by 32 days.

(21) Appl. No.: 17/183,126

(22) Filed: Feb. 23, 2021

(65) Prior Publication Data

US 2021/0287823 A1 Sep. 16, 2021

Related U.S. Application Data

(63) Continuation of application No. 14/942,709, filed on Nov. 16, 2015, now Pat. No. 10,930,407.

(60) Provisional application No. 62/123,540, filed on Nov. 21, 2014.

(51) Int. Cl.
*G21G 1/00* (2006.01)
*G21G 1/06* (2006.01)

(52) U.S. Cl.
CPC ..... *G21G 1/001* (2013.01); *G21G 1/06* (2013.01); *G21G 2001/0036* (2013.01)

(58) Field of Classification Search
CPC .. G21G 4/02; G21G 1/12; G21G 1/06; G21G 2001/0036
See application file for complete search history.

(56) References Cited

U.S. PATENT DOCUMENTS 3,940,318 A * 2/1976 Arino ..... G21C 1/303 423/2
4,995,948 A * 2/1991 Poa ..... C25C 3/34 205/47
6,011,825 A * 1/2000 Welch ..... G21G 1/10 376/195
2005/0200256 A1* 9/2005 Adamenko ..... G21G 1/10 313/238
2011/0096887 A1* 4/2011 Piefer ..... G21G 1/08 376/193
2011/0118491 A1* 5/2011 Wolterbeek ..... G21G 1/06 556/58
2012/0275557 A1* 11/2012 Gentile ..... G21G 1/12 376/158
2015/0098544 A1* 4/2015 Blanovsky ..... G21D 9/00 376/246

OTHER PUBLICATIONS

Van der Marck, Steven C., Arjan J. Koning, and Kevin E. Charlton. "The options for the future production of the medical isotope 99 Mo." (2010): 1817-1820. (Year: 2010).*

(Continued)

*Primary Examiner* — Lily C Garner
(74) *Attorney, Agent, or Firm* — Maschoff Brennan

(57) ABSTRACT

The present disclosure generally relates to methods and structures for the production of radioisotopes from the thermal neutron irradiation of selected natural isotopes. The methods, structures and operations are applicable to the production of any radioisotope that may be produced from neutron irradiation.

16 Claims, 4 Drawing Sheets

(56) References Cited

OTHER PUBLICATIONS

Tomar, Bhupendra S., et al. "Studies on production of high specific activity 99Mo and 90Y by Szilard Chalmers reaction." Radiochimica Acta 98.8 (2010): 499-506. (Year: 2010).*

Zhang, Zhiyong, et al. "Preparation of 186Re and 188Re with high specific activity by the Szilard-Chalmers effect." Journal of Labelled Compounds and Radiopharmaceuticals: The Official Journal of the International Isotope Society 43.1 (2000): 55-64. (Year: 2000).*

Zeisler, S., D. Becker, and K. Weber. "Szilard-Chalmers reaction in praseodymium compounds." Journal of radioanalytical and nuclear chemistry 240.2 (1999): 637-641. (Year: 1999).*

Zeisler, S., and K. Weber. "Szilard-Chalmers effect in holmium complexes." Journal of radioanalytical and nuclear chemistry 227. 1-2 (1998): 105-109. (Year: 1998).*

Tomar. Increasing the specific activity of medically useful radionuclides through Szilard Chalmers reaction. Jan. 2008. Transactions of the American Nuclear Society. 98:880-881. (Year: 2008).*

Van Dorp, Jan Willem J., et al. "Towards the production of carrier-free 99Mo by neutron activation of 98Mo in molybdenum hexacarbonyl-Szilard-Chalmers enrichment." Applied Radiation and Isotopes 140 (2018): 138-145. (Year: 2018).*

* cited by examiner

PRODUCTIONS OF RADIOISOTOPES

CROSS-REFERENCE TO RELATED APPLICATIONS

The present application claims priority to the U.S. patent application Ser. No. 14/942,709 which was filed Nov. 16, 2015, and the benefit of U.S. Provisional Patent Application Ser. No. 62/123,540, entitled MO-99 PRODUCTION, which was filed on Nov. 21, 2014, and is hereby incorporated by reference in its entirety.

BACKGROUND

Radioisotopes are useful and have broad applications in the medical sciences and healing arts. For example, the radioisotope Molybdenum-99 ("Mo-99") may be a source of Technetium-99m ("Tc-99m"), which may be used as a diagnostic and therapeutic tool. For example, Tc-99m may be well suited for radiometric scanning of internal organs due to its short half-life resulting in reduced radiation exposure and its characteristic radiation emissions. Tc-99m is the radioactive decay product of Mo-99.

Radioisotope sources have been prepared by separating fission product from irradiated uranium targets or by the irradiation of naturally occurring isotopes (e.g., molybdenum). Production of radioisotopes by neutron activation may result in only a small fraction of the irradiated uranium targets or the naturally occurring isotopes being converted to radioisotopes and the specific activity of the resulting product may be very low and therefore may be of limited medical use.

The subject matter disclosed herein is not limited to embodiments that solve any disadvantages or that operate only in environments such as those described above. Rather, this background is only provided to illustrate one exemplary area where some examples described herein may be practiced.

SUMMARY

The present disclosure generally relates to methods and structures for the production of radioisotopes from thermal neutron irradiation of natural isotopes. The methods and structures contained in the present disclosure may be applicable to the production of other radioisotopes produced via neutron irradiation with neutrons of any preferred energy.

The present disclosure may significantly increase the specific activity (e.g., Curies per unit mass) of a radioisotope produced and may greatly reduce a presence of non-active isotopes of associated activation products and/or other undesirable trace materials in a produced radioisotope.

Certain aspects associated with using fissile materials for nuclear fission and subsequent fission product separation may be decreased and/or eliminated. For example, certain concerns over safety, proliferation, safeguards, processing, disposal and licensing of radioactive materials may be reduced and/or eliminated.

The present disclosure may include methods and structures to provide an irradiation target of size, shape, orientation and electric charge that possesses properties for enhanced emission and sequester of electrically charged positive ions resulting from recoil gamma emission upon capture of thermal or other energy neutrons in an isotope.

The present disclosure may include methods and structures for the configuration and composition of positive ions generated in a target material with physical and electrical properties and pathways for the positive ions to travel relatively unimpeded within an electric field created in a fixture and deposit these resulting positive ions on a surface or interior of a negatively charged cathode. For example, during production of Mo-99, a fixture may effectively operate as an electrical capacitor with an electrical current flowing from a positively charged anode to a negatively charged cathode (e.g., cathode collector) as positive ions (e.g., activated Mo-99 ions) serving as electrical charge carriers.

The present disclosure may include methods and structures to measure, control and vary an electric field produced in the fixture to manipulate and maximize a yield of radioisotopes derived from the target material and collected on the negatively charged cathode of the fixture.

The present disclosure may include methods and structures to provide an irradiation target with sufficient density, composition, and configuration to satisfy the required production demands of a particular radioisotope.

These and other aspects, features and advantages of the present invention will become more fully apparent from the following brief description of the drawings, the drawings, the detailed description of preferred embodiments and appended claims.

This Summary is provided to introduce a selection of concepts in a simplified form that are further described below in the Detailed Description. This Summary is not intended to identify key features or essential characteristics of the disclosed subject matter, nor is this Summary intended to be used as an aid in determining the scope of the disclosed subject matter. Additional features and advantages will be set forth in the following description and may be learned by the practice of the invention. One of ordinary skill in the art, after reviewing this disclosure, will appreciate that the disclosed methods and structures may have other shapes, sizes, configurations, arrangements, and the like. These and other features of the present invention will become more fully apparent from the following description and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limits its scope. Additionally, it will be appreciated that while the drawings may illustrate preferred sizes, scales, relationships and configurations of the invention, the drawings are not intended to limit the scope of the claimed invention. The invention will be described and explained with additional specificity and detail through the use of the accompanying drawings in which:

DETAILED DESCRIPTION

For purposes of promoting an understanding of the disclosure, reference will now be made to the following embodiments and specific language will be used to describe the same. It will nevertheless be understood that no limitation or restriction of the scope of the disclosure is thereby intended, such alterations and further modifications in the described subject matter, and such further applications of the principles as described herein being contemplated as would normally occur to one skilled in the art to which the subject matter relates.

The disclosure is generally directed towards the production of radioisotopes. It will be understood that, in light of the present disclosure, various radioisotopes may be produced such as Mo-99. However, the methods, structures and operations discussed in the disclosure may be applicable to the production of any radioisotope that may be produced via neutron irradiation.

Additionally, to assist in the description of the production of radioisotopes, words such as top, bottom, front, rear, right and left are used to describe the accompanying figures. It will be appreciated, however, that the present invention can be located and employed in a variety of desired positions, including various angles, sideways and even upside down. A detailed description of exemplary methods and structures for the production of radioisotopes from the thermal neutron irradiation of selected natural isotopes is set forth below.

Figure 1:
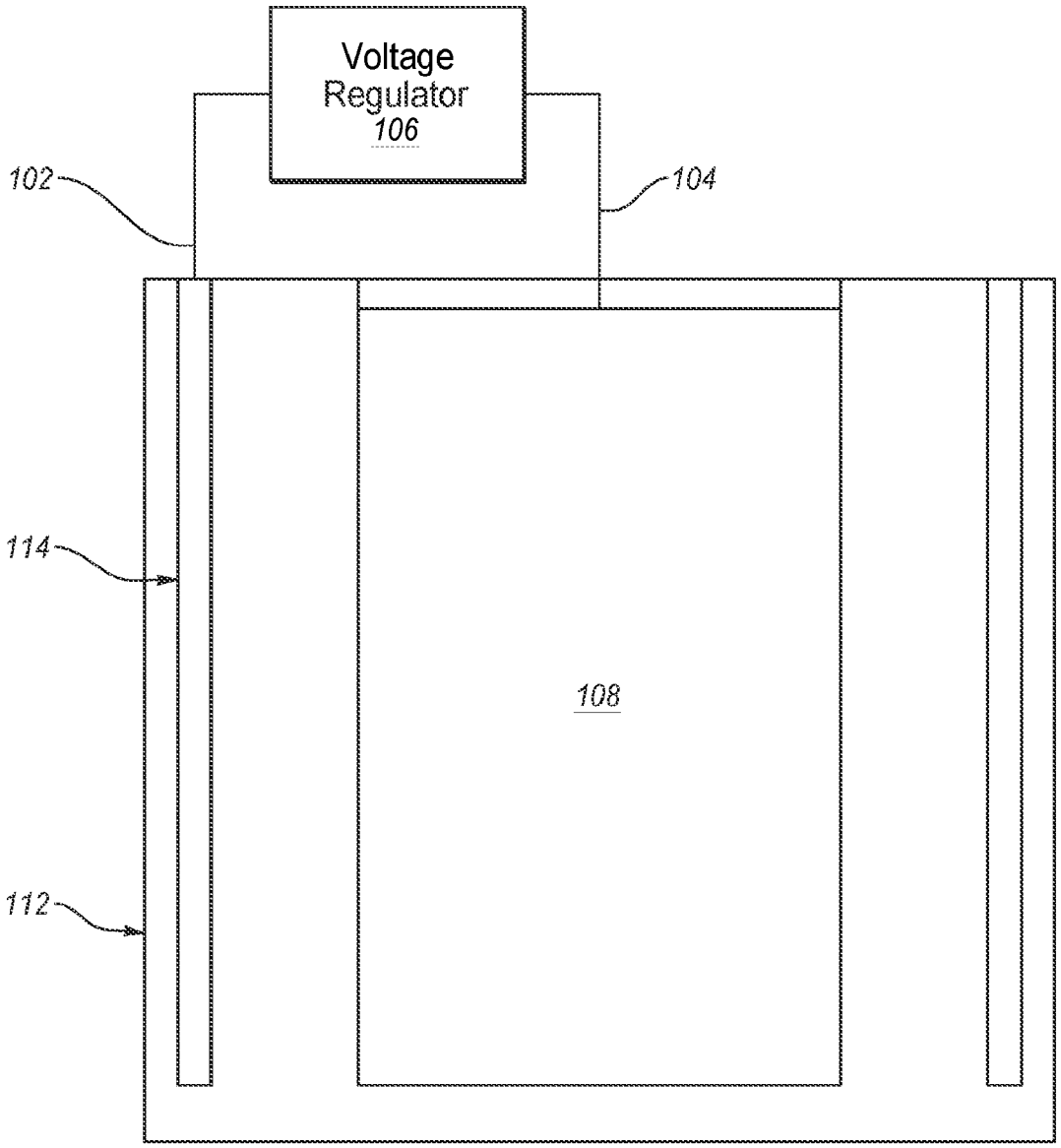
FIG. 1 is an exemplary schematic of a fixture that may be used for production of radioisotopes.

FIG. 1 is an exemplary schematic of a fixture 100 that may be used for production of radioisotopes. The fixture 100 may include one or more components such as a negative cathode 102, a positive anode 104, a voltage regulator 106, a high surface area target 108, a fixture wall 112, and a collector component 114.

The fixture 100 may be used to maintain a particular environment to allow and/or promote production of radioisotopes via neutron capture. For example, the fixture 100 may maintain a vacuum environment within the fixture walls 112. The fixture 100 may be placed within a neutron field. For example the fixture 100 may be placed within a nuclear reactor or other source of neutrons. The voltage regulator 106 may be electrically coupled to the negative cathode 102 and the positive anode 104 of the fixture 100. The voltage regulator 106 may apply a variable voltage between the negative cathode 102 and the positive anode 104. The positive anode 104 may be electrically coupled to the high surface area target 108 and the negative cathode 102 may be electrically coupled to the collector component 114. Adjusting a voltage difference between the high surface area target 108 and the collector component 114 may control and increase a recovery rate of radioisotopes created within the fixture 100.

In one configuration, a closed electrical circuit may be created between the high surface area target 108 and the positive anode 104 by an electrical conducting layer positioned on the high surface area target 108. In another configuration, a closed electrical circuit may be created between the high surface area target 108 and the positive anode 104 by an electrical conducting layer passing through the high surface area target 108. The electrical conducting layer may be in direct (e.g., electrical contact) with the high surface area target 108. Connecting the negative cathode 102 and the positive anode 104 to the voltage regulator 106 may complete (e.g., close) the electrical circuit for the collector component 114 and the high surface area target 108 to produce radioisotopes via neutron capture.

The high surface area target 108 may be comprised of molybdenum or other isotopes of various isotopic concentrations. The highs surface area target 108 may be located within the vacuum environment created within the fixture 100. The high surface area target 108 and other materials within the fixture 100 may be thermally heated or electrically heated prior to or after being placed within the fixture 100. For example, the high surface area target 108 and other materials within the fixture 100 may be electrically heated via a temporary electrical connection within the fixture 100. Heating the high surface area target 108 and other materials within the fixture 100 may remove contaminants during evacuation of the atmosphere surrounding the high surface area target 108 and other materials within the fixture 100. If contaminants are located on the high surface area target 108, the processes and methods disclosed herein may be inhibited. The high surface area target 108 may be designed to allow for and promote release of positively charged ions from the one or more surfaces of the high surface area target 108. Configurations of the high surface area target 108 may include sheets, wire, gauze, particulates, powders, Nano size-powders, spheres, whiskers, and/or other practicable structures or different combinations. For example, the high surface area target 108 may be a high surface area molybdenum composition made of foils, wires, powders, and/or crystals. The high surface area target 108 may include molybdenum and/or a molybdenum composition, and the target may be constructed from particulates, thin solid and perforated layers, mesh, gauze, metal wool, and the like. One of ordinary skill in the art will appreciate, after reviewing this disclosure, that the high surface area target 108 may be made from other materials, composites and the like with suitable properties and characteristics, and the high surface area target 108 may have various appropriate shapes, sizes, configurations, arrangements, and the like. In one embodiment, the high surface area target 108 may be designed in such a way as to increase surface area of the high surface area target 108 to allow more positive ions to be released within the fixture 100 during operation within the field of a neutron flux.

The fixture 100 may be exposed to a neutron flux or neutrons of other energy distributions causing the high surface area target 108 to be exposed to the neutron flux. Exposure to a neutron flux may cause the high surface area target 108 to absorb neutrons. Absorbing neutrons may cause nuclei of atoms located within the high surface area target 108 to recoil. When a nucleus of an atom located within the high surface area target 108 recoils, kinetic energy may be created that is sufficient to rupture atomic bonds holding the atom in the high surface area target 108. The kinetic energy delivered to the atom may be within the range from a few eV to MeV, but the kinetic energy may be larger or smaller (in this exemplary embodiment, eV refers to an electron-volt or electron volt and MeV refers to $10^6$ eV). The kinetic energy of the atom may cause the atom to escape from a surface of the high surface area target 108 as a positively charged ion into the vacuum environment within the fixture 100. The high surface area target 108 may be positively charged electrically and may repel any released positively charged ions from reattaching or combining with the high surface area target 108.

The released positively charged ions may move towards the negatively charged collector component 114 due to the electric field created by the difference in electric charge between the positively charged high surface area target 108 or positive anode 104 and the collector or negatively charged collector component 114. For example, the negatively charged collector component 114 may be a negatively charged cathode, which electrically attracts and collects the positively charged ions on a surface or an interior of the negatively charged cathode. The negatively charged collector component 114 may be designed to reduce induced radioactivity or parasitic neutron capture by the collector component 114 in a neutron field. In one embodiment, pure graphite may be used as the collector component 114 (e.g., carbon with low hafnium contents and other neutron absorbers) due to graphite's electric and thermal properties and graphite's low activation by neutron absorption. In another embodiment, reactor grade graphite may be used as the collector component 114 due to graphite's electric and thermal properties and graphite's low activation by neutron absorption.

The positively charged ions that are collected by the collector component 114 may be separated from the collector component 114 and prepared in appropriate chemical and physical form for distribution and various applications.

Figure 2:
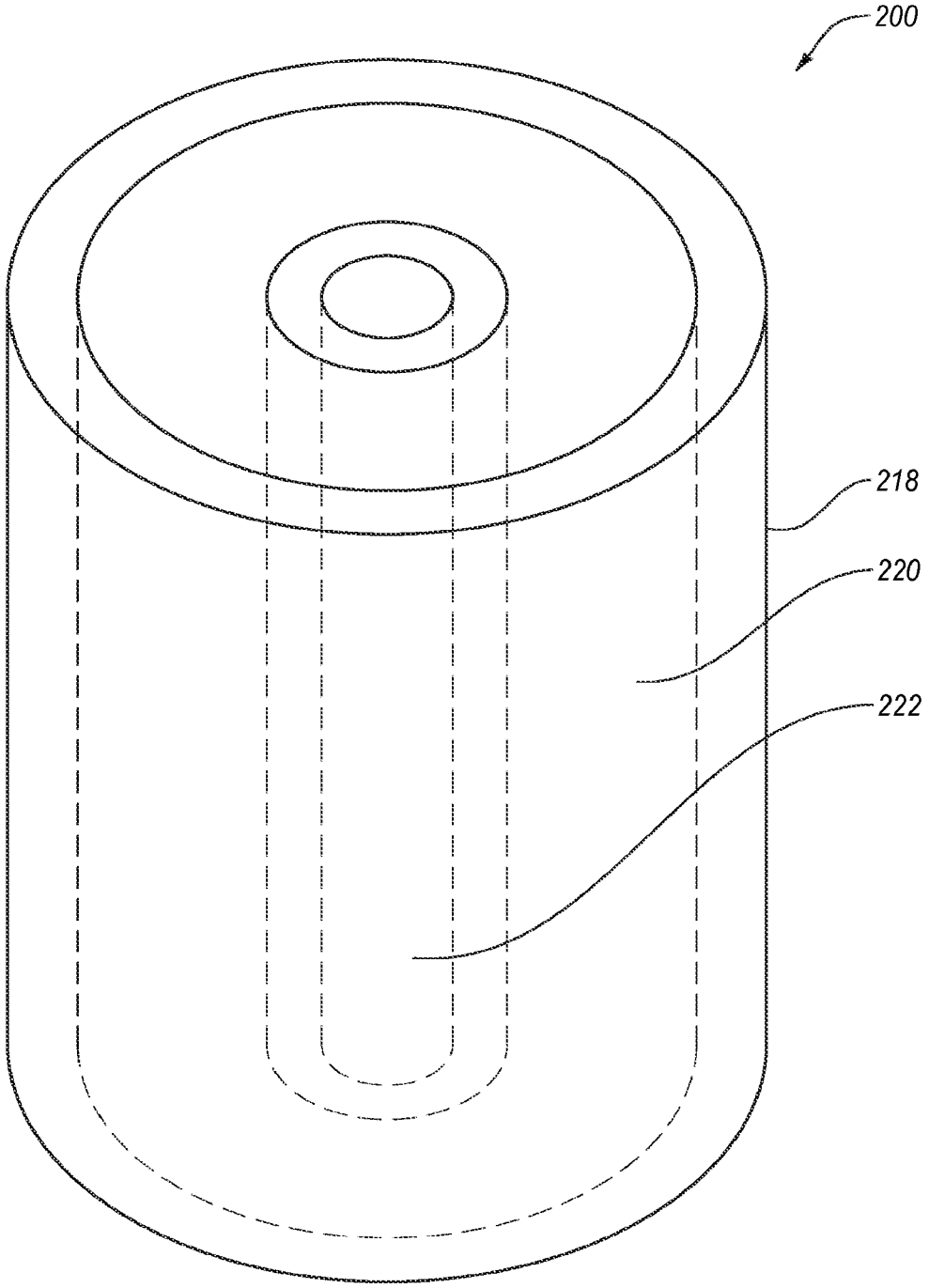
FIG. 2 is an exemplary schematic of another fixture that may be used for production of radioisotopes.

FIG. 2 is a schematic of an exemplary operational fixture 200. The fixture 200 may be a reusable irradiation container for repetitive production of radioisotopes. The fixture 200 may be used in accordance with at least some embodiments and methods disclosed herein. The fixture 200 may include one or more parts and components such as an outer reusable containment shell 218, a circumferential source material canister 220, and/or a cathode collector 222.

The fixture 200 may be used to maintain a particular environment to allow production of radioisotopes via neutron capture. The outer reusable containment shell 218 may be used to create and maintain a vacuum environment for contents located within the fixture 200. The outer reusable containment shell 218 may be made of materials that have low neutron capture cross sections. For example, magnesium, aluminum, and/or zirconium metals and alloys may be used to make the outer reusable containment shell 218. One of ordinary skill in the art will appreciate, after reviewing this disclosure, that the containment shell 218 may be constructed from other materials with appropriate properties and characteristics.

The circumferential source material canister 220 may be located within the outer reusable containment shell 218 of the fixture 200. The circumferential source material canister 220 may include a target material to capture neutrons. The target material may be the high surface area target 108 discussed in relation to FIG. 1. For example, the target material may be comprised of molybdenum or other natural isotopes. The shape and form of the circumferential source material canister 220 may be designed in order to increase a surface area of the target material that is exposed to a neutron flux. Increasing the surface area of the source material canister 220 may increase a release rate of positive ions into the vacuum space within the fixture 200. In one embodiment, the target material and any other materials placed within the fixture 200 may be thermally heated or electrically heated before being placed within the fixture 200. In another embodiment, the target material and any other materials placed within the fixture 200 may be thermally heated or electrically heated after being placed within the fixture 200. Heating the target material may remove contaminants during evacuation of the atmosphere in the fixture 200 that may inhibit the processes and methods disclosed herein.

The circumferential source material canister 220 may have a positive electrical charge to provide a positive electrical charge to the target material located within the circumferential source material canister 220. Applying a positive electrical charge of selected values to the target material may increase recovery of radioisotopes created within the fixture 200.

When the target material located within the circumferential source material canister 220 absorbs neutrons, activated atoms located within the target material may recoil. When an activated atom recoils due to prompt and/or delated gamma emission, kinetic energy may be created that is sufficient to rupture atomic bonds holding the activated atom in the target material. The kinetic energy delivered to the activated atom may be within the range from a few eV to MeV, but the kinetic energy may be larger or smaller. The kinetic energy of the activated atom may cause the activated atom to escape from a surface of the target material as a positively charged ion into the vacuum environment within the fixture 200. The positive electric charge of the target material may repel any released positively charged ions from reattaching to the target material and may cause the positively charged ions to move within the vacuum environment and be attracted to and collected by the negatively charged cathode 222.

The circumferential source material canister 220 and fixture wall 218 may be made of materials that have low neutron capture cross sections. For example, magnesium, aluminum, and/or zirconium metals and alloys may be used to make the circumferential source material canister 220. One of ordinary skill in the art will appreciate, after reviewing this disclosure, that the material canister 220 and other components within the fixture 200 may be constructed from other materials with appropriate nuclear and chemical properties and characteristics.

The circumferential source material canister 220 may use compacting, bonding, mechanical rotation and/or screening to prevent movement of the target material towards the cathode collector 222, other than the positively charged ions created within the fixture 200. The circumferential source material canister 220 may prevent macroscopic movement of the target material by, for example, compaction fencing. Compaction fencing may include mesh with openings that are smaller in size than material particles of the target material. The reusable containment shell 218 may also prevent movement of the target material. The reusable containment shell 218 may rotate axially at a speed that is sufficient to restrain the target material particles using centripetal forces as produced in centrifuges.

The cathode collector 222 may be at least partially surrounded by the circumferential source material canister 220. The cathode collector 222 may be negatively charged and may attract the positively charged ions released into the vacuum space via neutron capture. The positively charged ions may travel and attach to the surface or interior of the cathode collector 222 and may be held by physical, atomic and/or electrical forces.

The positively charged ions that are collected by the cathode collector 222 may be separated from the cathode collector 222 and prepared in chemical and physical form for distribution and utilization.

Figure 3:
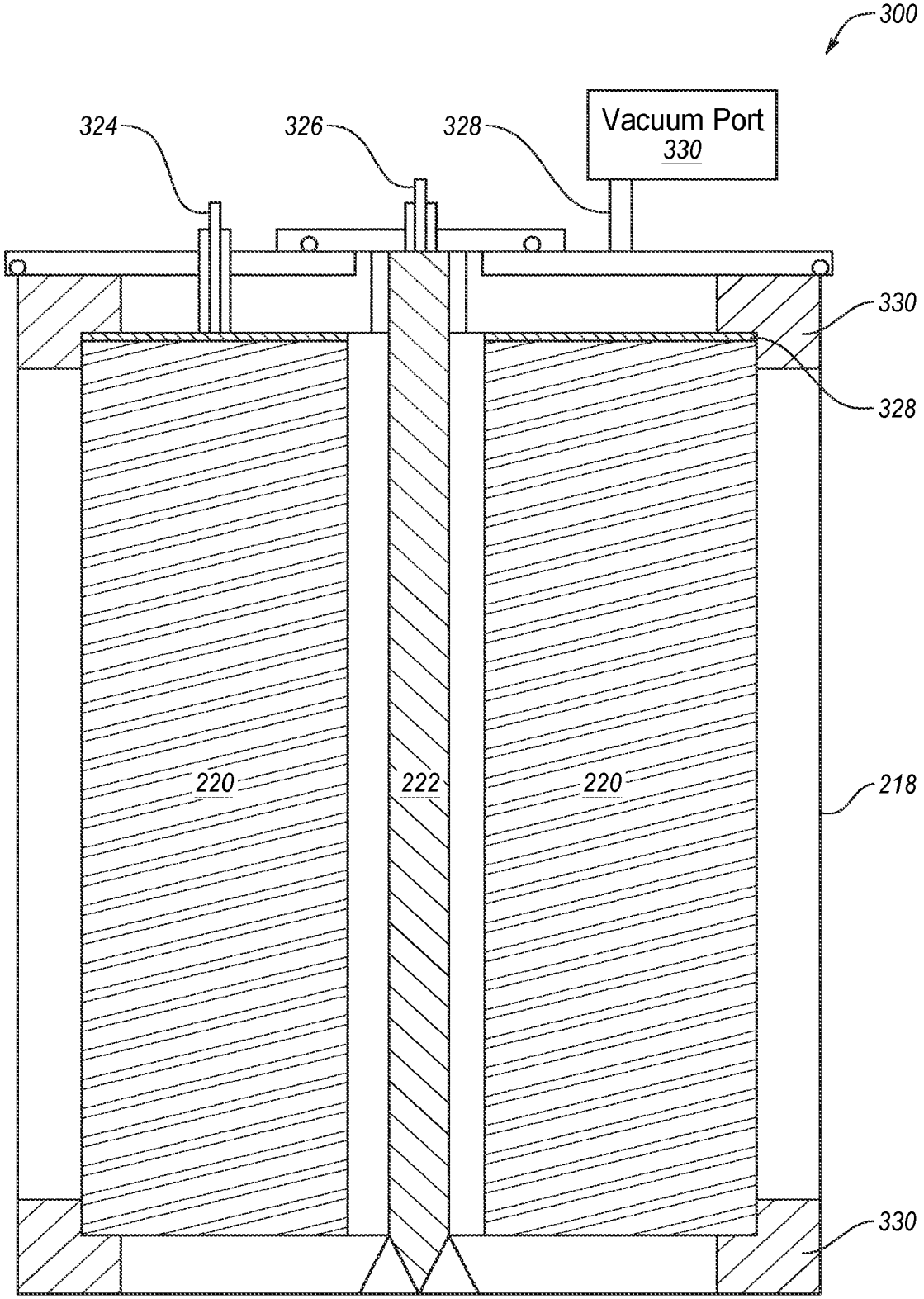
FIG. 3 is an exemplary schematic of still another fixture that may be used for production of radioisotopes.

FIG. 3 is a schematic of an exemplary fixture 300 that may be used for production of radioisotopes such as Mo-99. The fixture 300 may have one or more parts and/or components that are similar or identical to the parts and/or components used in connection with the fixture 200 discussed in relation FIG. 2. For convenience, similar or identical parts and/or compounds may, but not necessarily, have the same reference numbers. One of ordinary skill in the art will appreciate, after reviewing this disclosure, that fixtures 200 and 300 may have one or more similar or different parts and/or components depending, for example, upon the intended use of the fixture. One of ordinary skill in the art will also appreciate, after reviewing this disclosure, that fixtures 200 and 300 may have different shapes, sizes, configurations, and/or arrangements depending, for example, upon the intended use of the fixture.

As shown in FIG. 3, an anode 324 may be electrically coupled to the circumferential source material canister 220. The anode 324 may provide a positive electric charge of a selected value to the target material located within the circumferential source material canister 220. A cathode 326 may be electrically coupled to the cathode collector 222. The cathode 326 may provide a negative electric charge of a selected value to the cathode collector 222.

The fixture 300 may include a vacuum port 328. The vacuum port 328 may allow a vacuum environment to be created within the fixture 300. A device may be connected to the vacuum port 328 and may allow the environmental gas pressure within the outer reusable containment shell 218 to be reduced for enhancing production of the positive ions released from the anode 324.

A spatial relationship may exist between the outer reusable containment shell 218, the circumferential source material canister 220, and/or the cathode collector 222. The spatial relationship of components in the containment shell 218 may be maintained by structural supports 330 such as spacers and/or electrical insulators of proper composition and design to support interior components and allow the vacuum environment to surround the circumferential source material canister 220 and the cathode collector 222. The structural supports 330 may isolate a negative electric charge of the cathode collector 222 and a positive electric charge of the circumferential source material canister 220.

Figure 4:
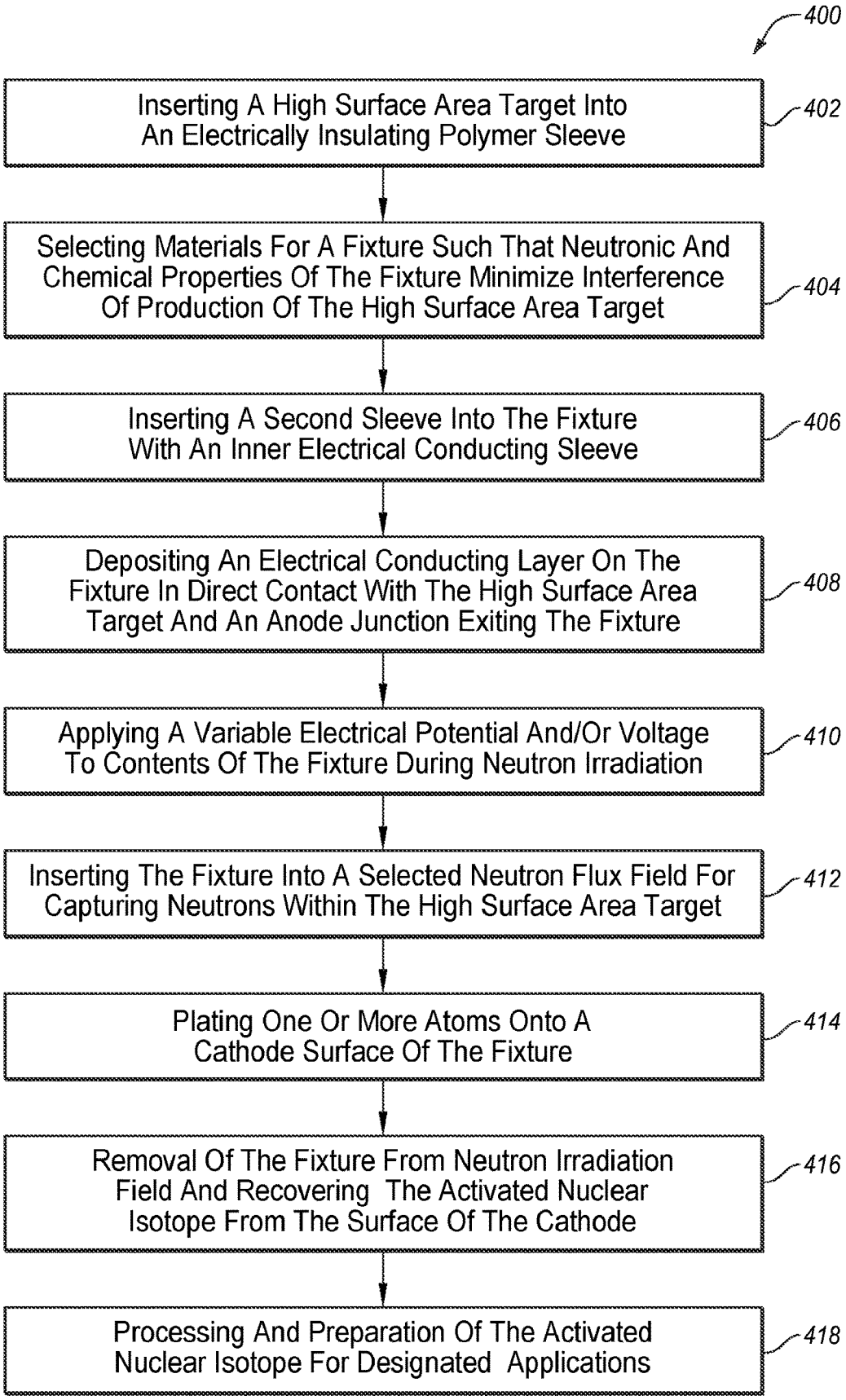
FIG. 4 is a flow chart of an exemplary method for producing radioisotopes via neutron capture.

FIG. 4 is a flowchart of an exemplary method 400 for producing radioisotopes via neutron capture, in accordance with at least some embodiments described herein. The method 400 may be implemented, in some embodiments, by a fixture, such as the fixtures 100, 200 and/or 300 of FIG. 1, 2, or 3 respectively. Although illustrated as discrete blocks, various blocks may be divided into additional blocks, combined into fewer blocks, or eliminated, depending on the desired implementation for maintaining the desired integrity of the system.

The method may begin at block 402 where a high surface area target may be inserted into an electrically insulating sleeve. In block 404, materials for a fixture may be selected. The materials may be selected such that neutronic and chemical properties of the fixture minimize interference of production of the high surface area target. In block 406, a second sleeve may be inserted into the fixture with an inner conducting sleeve. In block 408, an electrical conducting layer may be deposited. The electrical conducting layer may be in direct contact with the high surface area target and an anode junction of the fixture.

In block 410, a variable electrical potential and/or voltage may be applied to contents of the fixture during neutron irradiation. In block 412, the fixture may be inserted into a selected neutron flux field for capturing neutrons within the high surface area target.

In block 414, one or more activated atoms may be plated onto a cathode surface of the fixture. In block 416, the fixture may be removed from the neutron irradiation field and the activated nuclear isotopes may be recovered from a surface of the cathode. In block 418, the one or more activated nuclear isotopes may be processed and prepared for designated applications.

One skilled in the art will appreciate that, for this and other processes and methods disclosed herein, the functions performed in the processes and methods may be implemented in differing order and configurations. Furthermore, the outlined steps and operations are only provided as examples, and some of the steps and operations may be optional, combined into fewer steps and operations, or expanded into additional steps and operations without detracting from the essence of the disclosed embodiments. For instance, the high surface area target may include broad spectrum of material configurations such as sheets, wire gauze, particulates, powders, spheres, whiskers, and/or other practicable structures or different combinations derived from isotopes. The cathode surface may include reactor grade graphite with low neutron capture properties.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description and drawings. All changes, which come within the meaning and range of equivalency of the claims, are to be embraced within their scope.

What is claimed is:

1. A method for producing Mo-99 via neutron capture comprising:

disposing a fixture within a nuclear reactor, the fixture sized and configured to be exposed to a neutron field of the nuclear reactor, the fixture comprising a source material at least partially comprising Mo-98 target material, a positively charged anode providing a positive electric charge to the Mo-98 target material, a cathode collector spaced apart from the source material such that an environment is disposed between the cathode collector and the source material, a negatively charged cathode electrically coupled to the cathode collector to provide a negative electric charge to the cathode collector; and a vacuum port; and creating a vacuum environment within the fixture, the vacuum environment including at least a portion of the environment disposed between the cathode collector and the source material;

wherein exposure of the Mo-98 target material to the neutron flux field of the nuclear reactor produces Mo-99 ions from the Mo-98 target material; and wherein the cathode collector is configured to collect the Mo-99 ions.

2. The method of claim 1, wherein the vacuum environment disposed between the cathode collector and the source material has a generally annular configuration.

3. The method of claim 1, wherein the positively charged anode is connected to the fixture; and wherein the negatively charged cathode is connected to the fixture.

4. The method of claim 1, wherein the Mo-98 target material is disposed near an outer surface to facilitate production of Mo-99.

5. The method of claim 1, wherein the positively charged anode is electrically coupled to the Mo-98 target material.

6. The method of claim 1, further comprising providing an electrical conducting layer disposed on the Mo-98 target material, the electrical conducting layer connected to the positively charged anode.

7. The method of claim 1, wherein the Mo-98 target material includes at least one of the following: a sheet of the Mo-98 target material, a wire gauze of the Mo-98 target material, particulates of the Mo-98 target material, powders of the Mo-98 target material, spheres of the Mo-98 target material, and/or whiskers of the Mo-98 target material.

8. The method of claim 1, further comprising providing a containment shell and a structural support for the fixture.

9. The method of claim 1, wherein the source material is disposed within a source material canister.

10. The method of claim 1, wherein the Mo-98 target material comprises one or more whiskers.

11. The method of claim 1, wherein the Mo-98 target material comprises one or more or a combination of a sheet of the Mo-98 target material, a wire gauze of the Mo-98 target material, particulates of the Mo-98 target material, powders of the Mo-98 target material, spheres of the Mo-98 target material, and whiskers of the Mo-98 target material.

12. The method of claim 1, wherein the source material is disposed within a source material canister, the source material canister being comprised of one or more or a combination of a magnesium metal, an aluminum metal, and zirconium metal.

13. The method of claim 1, further comprising providing a compaction fencing that includes a mesh with openings that are smaller in size than material particles of the Mo-98 target material.

14. The method of claim 1, further comprising providing an electric field at least partially disposed between the source material and the cathode collector;

wherein exposure of the Mo-98 target material to the neutron flux field within a nuclear reactor produces positively charged ions from the Mo-98 target material; and wherein the positively charged ions move towards the negatively charged cathode collector due to the electric field.

15. The method of claim 1, further comprising providing a containment shell, a structural support, and a source material canister, the source material disposed within the source material canister.

16. The method of claim 1, wherein the exposure of the Mo-98 target material to the neutron flux field within the nuclear reactor produces Mo-99 from the target material via neutron capture.

* * * * *